US008196666B2

(12) United States Patent
Askestad

(10) Patent No.: US 8,196,666 B2
(45) Date of Patent: Jun. 12, 2012

(54) FLEXIBLE RISER AND METHOD FOR PULLING-IN AND HANGING UP THEREOF

(75) Inventor: Sigmund Askestad, Tvedestrand (NO)

(73) Assignee: Advanced Production and Loading AS, Kolbjornsvik (NO)

( * ) Notice: Subject to any disclaimer, the term of this patent is extended or adjusted under 35 U.S.C. 154(b) by 134 days.

(21) Appl. No.: 11/912,276

(22) PCT Filed: Apr. 24, 2006

(86) PCT No.: PCT/NO2006/000149

§ 371 (c)(1),
(2), (4) Date: Jan. 10, 2008

(87) PCT Pub. No.: WO2006/112730

PCT Pub. Date: Oct. 26, 2006

(65) Prior Publication Data

US 2008/0283248 A1 Nov. 20, 2008

(30) Foreign Application Priority Data

Apr. 22, 2005 (NO) ..... 20051988

(51) Int. Cl.
*E21B 17/01* (2006.01)

(52) U.S. Cl. ..... 166/367; 166/338; 166/341; 166/343; 166/352; 405/158; 405/168.1; 405/224.2

(58) Field of Classification Search ..... 166/367, 166/338, 341, 343, 349, 352, 359, 339, 344–346, 166/241.1; 405/195.1, 158, 168.1, 168.2, 405/169, 170, 211, 224, 224.2–224.4; 114/264–266
See application file for complete search history.

(56) References Cited

U.S. PATENT DOCUMENTS

| | | | | |
|---|---|---|---|---|
| 4,633,801 | A * | 1/1987 | Marshall | 114/266 |
| 4,808,034 | A * | 2/1989 | Birch | 405/195.1 |
| 5,947,642 | A * | 9/1999 | Teixeira et al. | 405/195.1 |
| 6,155,193 | A * | 12/2000 | Syvertsen et al. | 114/230.12 |
| 6,220,303 | B1 * | 4/2001 | Secher et al. | 138/110 |
| 6,352,115 | B1 * | 3/2002 | Mathieu | 166/352 |
| 6,558,084 | B2 * | 5/2003 | Moog et al. | 405/224 |
| 7,293,940 | B1 * | 11/2007 | Perreau-Saussine et al. | 405/224.2 |
| 7,387,469 | B2 * | 6/2008 | Duggan | 405/211 |
| 7,575,254 | B2 * | 8/2009 | Cunha Xavier et al. | 285/45 |
| 7,690,434 | B2 * | 4/2010 | Baross et al. | 166/354 |
| 2006/0177273 | A1 * | 8/2006 | Bonnemaire et al. | 405/211 |

FOREIGN PATENT DOCUMENTS

| | | |
|---|---|---|
| WO | WO-93/24733 A1 | 12/1993 |
| WO | WO-2005/095198 A1 | 10/2005 |

* cited by examiner

*Primary Examiner* — Thomas Beach
*Assistant Examiner* — Matthew Buck
(74) *Attorney, Agent, or Firm* — Birch, Stewart, Kolasch & Birch, LLP

(57) ABSTRACT

Flexible riser, comprising
a length of a flexible pipe with
an upper end, a bend restrictor and a termination for hanging up on a vessel, a floating installation or a platform,
distinguished in that the bend restrictor in the upper end is connected to
an adapter pipe extending from a lower end at the bend restrictor to an upper end, to
an end coupling to which the upper ends of both the flexible pipe and the adapter pipe are fastened, the flexible riser extending through the bend restrictor and the adapter pipe and the end connection comprising a means for hanging up at deck level of the vessel, the installation or the platform.
Method for pulling-in and hanging up of the flexible riser.

8 Claims, 3 Drawing Sheets

FLEXIBLE RISER AND METHOD FOR PULLING-IN AND HANGING UP THEREOF

FIELD OF THE INVENTION

Figure 1:
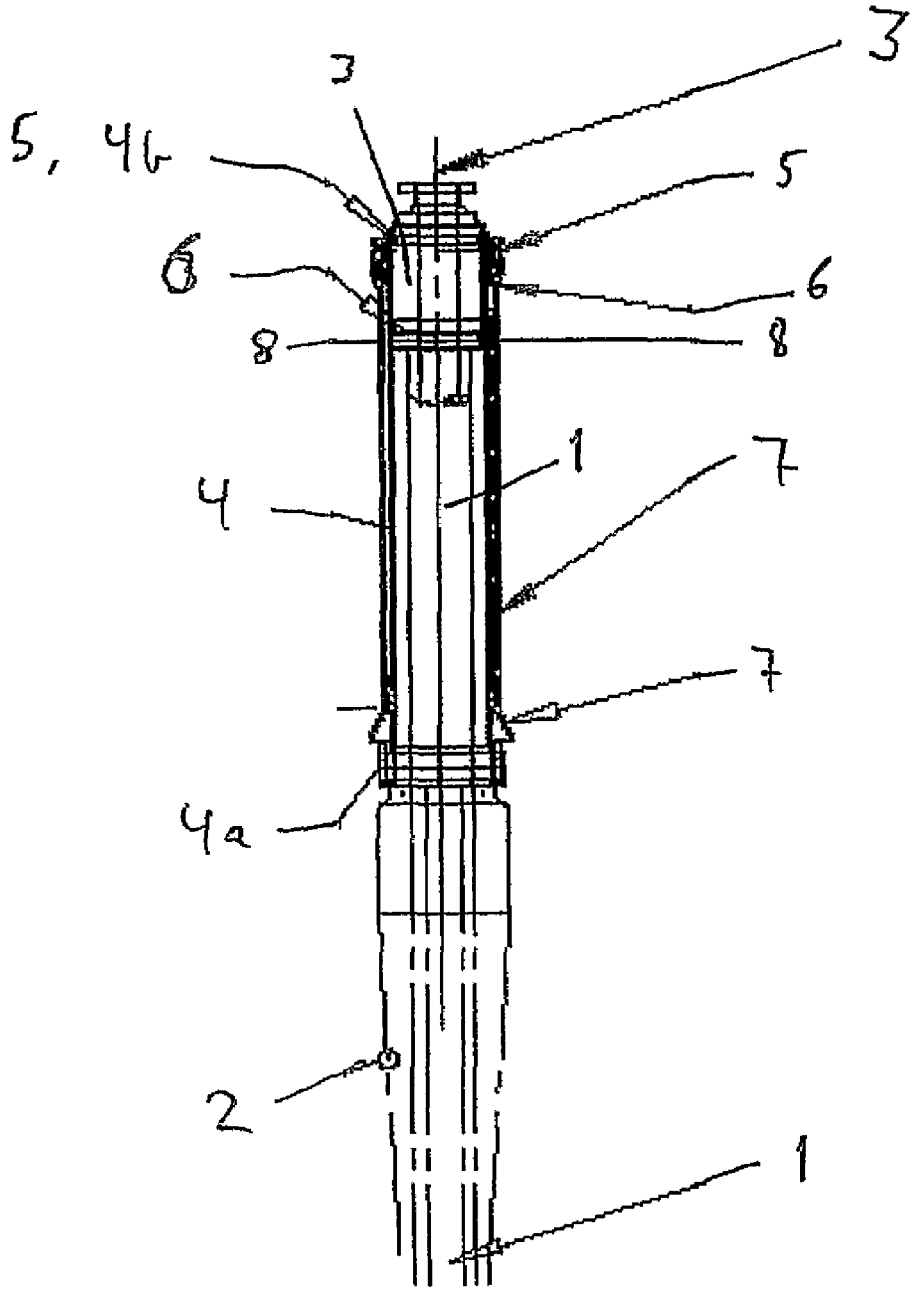

The present invention relates to flexible risers and hanging up thereof on a vessel, a floating installation or a platform.

BACKGROUND OF THE INVENTION AND PRIOR ART

Pull-in and hanging up of flexible risers to for example an FPSO (a vessel for floating production, storage and offloading) is a comprehensive and time consuming operation.

At arrival to the field the risers will normally have been laid down on the sea bed. The risers are pulled up to the vessel by use of a winch, optionally by assistance of an installation vessel. In the case with a FPSO it is usual practice to use a turret, through which the risers are pulled in through dedicated guiding pipes by use of a winch. Preferably a guiding sheave is used, which can be positioned along a runway on the turret, and a wire arranged between the winch, over the guiding sheave and to the upper end of the flexible riser. There are two dominating methods for hanging up of the risers. By the first method, the risers are brought up through a guiding pipe in the turret to deck level, where it is hanged up on a flange connection or similar, and can be connected to other equipment, for example a process plant. By the other method both the riser and the bend restrictor is brought up to the lower edge of the turret, where a connection to a dedicated coupling at the lower end of a stiff pipe extending through the guiding pipe in the turret is made. By both methods a bend restrictor is fastened to the lower end of the guiding pipe. The first method has advantage by the hanging up of the riser being made at deck level of the vessel, compared to the other method for which the hanging up of both the riser and the bend restrictor is made at the lower end of the guiding pipe. All work under the turret and hull is difficult, and is usually undertaken in a difficult working position under water, which is the case also for the first method, more specifically, fastening of the bend restrictor. However, coupling mechanisms exist to facilitate the assembly, but the mechanisms take up a substantial space and are susceptible to damage. The methods results in two working operations, of which the hanging up of risers, and mounting of bend restrictors, are undertaken successively.

The bend restrictor transfers large forces from the riser to the fastening in the lower end of a stiff guiding pipe. The torques and stresses become very high compared to the capacity of flexible risers.

The constructions according to the above-mentioned methods results in some difficult working operations, they are complicated and clumpy, and are not feasible for hanging up by working operations undertaken only at deck level, and results in a high mechanical load level.

There is a demand for a construction of an upper termination for flexible pipes, which results in that all work can be undertaken at a deck level, with less torque and stresses on the flexible pipe as hanged up, with larger extent of pre-assembly, with less and simpler working operations to hang up the riser, with more compact construction to facilitate pull-in, and with construction such that the forces are taken up in the longitudinal direction of the pipe with respect to the fastening means at deck level.

SUMMARY OF THE INVENTION

The above mentioned demand is met by the present invention providing a flexible riser, comprising a length of a flexible pipe with an upper end, a bend restrictor and a termination for hanging up on a vessel, a floating installation or a platform, distinguished in that the bend restrictor in an upper end is connected to an adapter pipe extending from a lower end at the bend restrictor to an upper end, to an end coupling to which the upper ends of both the flexible pipe and the adapter pipe are fastened, the flexible riser extending through the bend restrictor and adapter pipe and the end coupling comprising a fastening for hanging up at deck level on the vessel, the installation or the platform.

With the flexible riser according to the invention the upper end termination can be assembled beforehand, and the flexible riser can be pulled up with the end coupling to deck level and fastened there by use of for example a fastening clamp that is secured by one or two bolts. The working operation is relatively simple and can be undertaken in its entirety at deck level. The forces applied to the flexible riser by current and waves distribute over a larger area because the flexible riser is moveable in the length within the adapter pipe, above the bend restrictor, such that the stresses are reduced and the service life of the riser is extended.

The bend restrictor with the adapter pipe is preferably slidable relative to the flexible riser and end coupling, which is beneficial with respect to assembly beforehand and gives better possibility for adaptions during installation and replacement at maintenance.

The end coupling preferably comprises an external groove to fasten the riser with a fastening clamp. The end coupling preferably comprises a lifting eye (pad eye), for use during pull-in and hanging up. The adapter pipe between the end coupling and bend restrictor, outside of the flexible pipe, is preferably a stiff, rigid pipe, for example a steel pipe, which preferably in its upper end comprises an internal groove (collar, collet, flange) for fastening on the end coupling. The upper part of the adapter pipe, optionally the whole adapter pipe, preferably consists of half segments that provide a compact connection between the adapter pipe and end coupling, such that a complete riser with bend restrictor, adapter pipe and end coupling easily can be passed through a guiding pipe in a turret. Preferably, an external conical groove is arranged in the upper end of the adapter pipe, for self-centering of the riser. It is preferably arranged an external conical groove in the lower end of the end coupling, for self-centering when hanging up.

With the invention also a method for pulling-in and hanging up on a floating installation or a vessel of a flexible riser according to the present invention is provided, distinguished in that a line is arranged from a winch on the vessel or installation to the upper end on the riser, the riser is pulled in by the winch through a guiding pipe in a turret arranged on the vessel or the installation, the riser is pulled in to a position for fastening with a fastening means at deck level on the vessel or the installation, the riser is fastened by use of the fastening means and thereby hanged up.

The riser is preferably fastened by a clamp that preferably is locked by one or two bolts.

DRAWINGS

The present invention is illustrated with figures, of which

Figure 2:
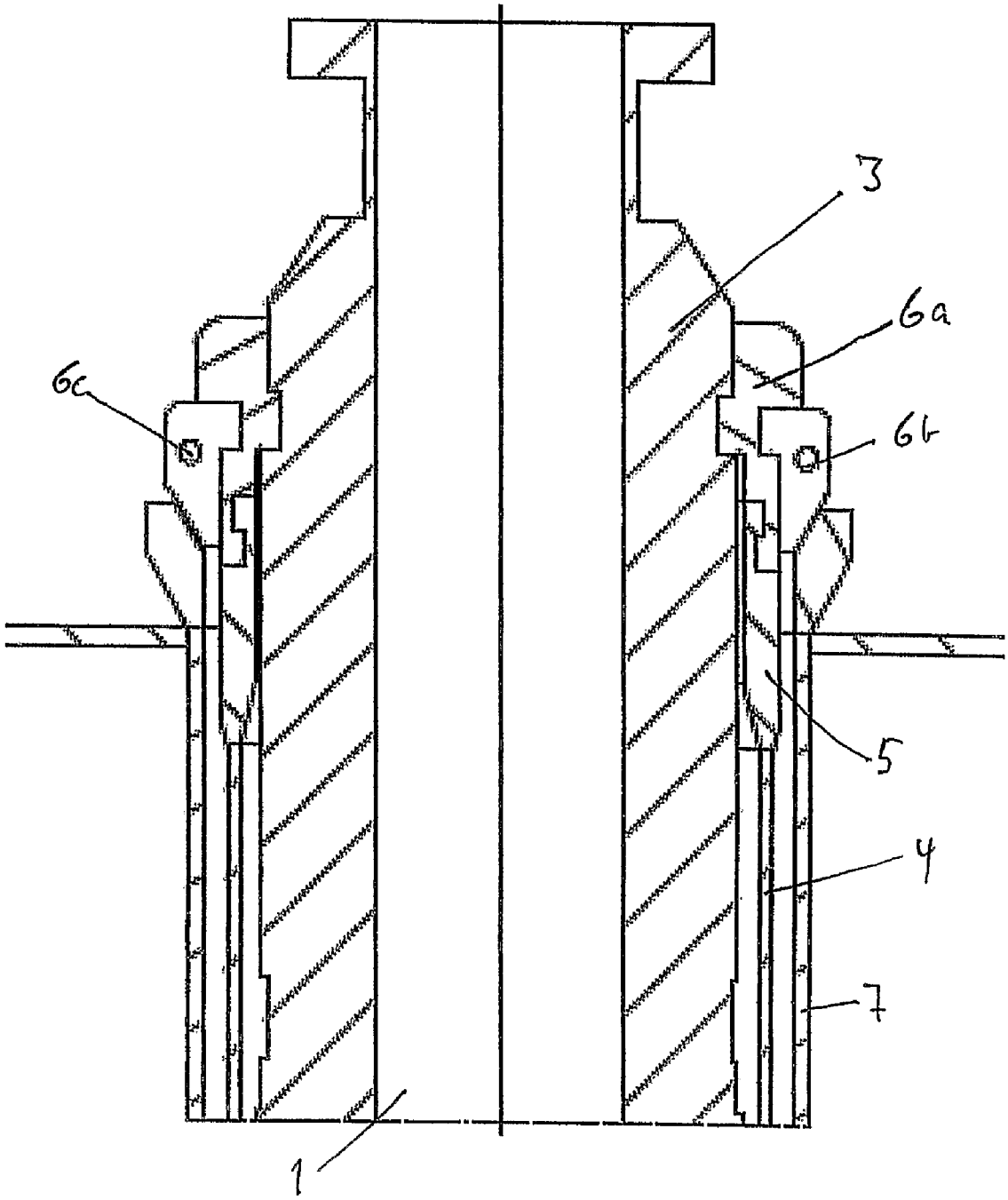
Figure 3:
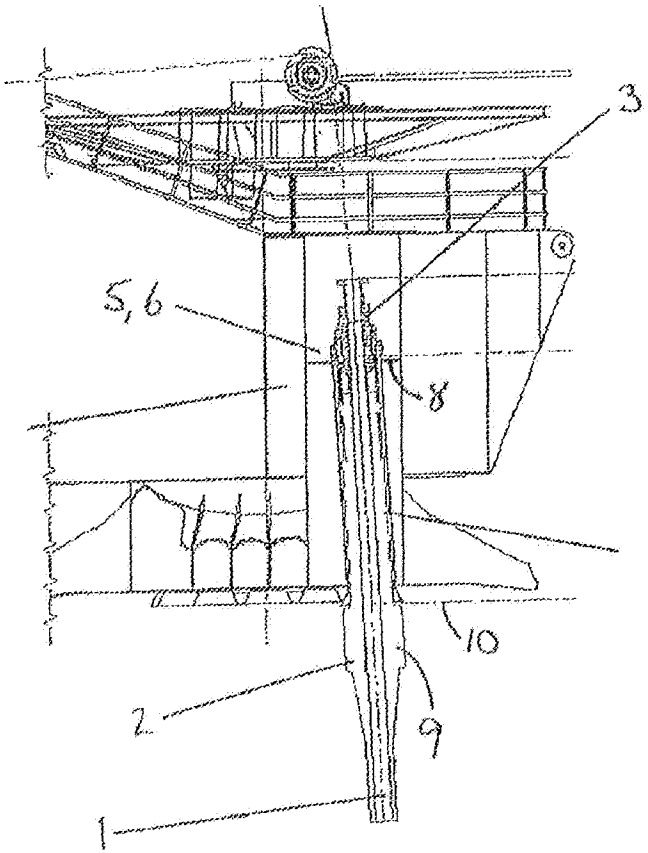
Figure 3:
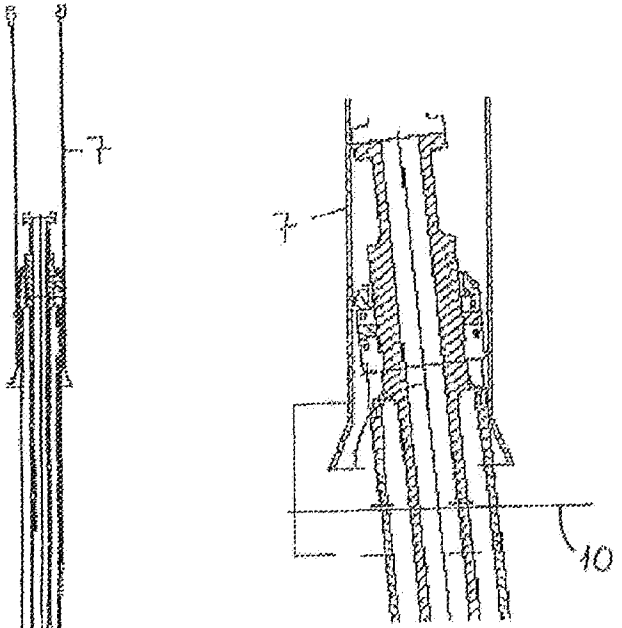

FIG. 1 illustrates the termination of a flexible riser according to the invention, FIG. 2 illustrates in further detail the riser with end coupling as illustrated on FIG. 1, and FIG. 3 illustrates pull-in of a flexible riser according to the invention.

DETAILED DESCRIPTION

Reference is first made to FIG. 1 that illustrates an embodiment of a flexible riser according to the invention, in the upper terminated end thereof. More specifically, it is illustrated a length of a flexible riser 1 with a bend restrictor 2 and an upper termination 3 for hanging up on a vessel, a rig or a platform, and coupling to equipment or plants on board. The bend restrictor 2 is in the upper end connected to an adapter pipe 4 that extends from a lower end 4*a* at the bend restrictor to an upper end 4*b*. The flexible riser 1 extends through the adapter pipe, to an end coupling 3 (termination) where it is fastened. The end coupling 3 comprises a fastening 5 for the adapter pipe and a fastening 6 for hanging up the end coupling at deck level on the vessel, the rig or the platform. On FIG. 1 the flexible riser is pulled through a guiding pipe 7 in a turret, where the deck level 8 on the turret is indicated.

Reference is made to FIG. 2 that illustrates further details of the end coupling 3 and the upper part of the flexible riser. The end coupling 3 appears more clearly, and the adapter pipe 4 is fastened to the end coupling in a dedicated fastening 5, arranged as a groove in the end coupling. It is illustrated a clamp 6*a* for fastening of the riser to the turret at deck level. The clamp is secured by two bolts 6*b* and 6*c*. In a more preferred embodiment the groove for fastening of the clamp, for hanging up at deck level, is located on the end coupling above the groove for fastening of the adapter pipe 4. This is preferable because it provides increased flexibility and greater independency for the fastenings.

FIG. 3 illustrates how the riser is pulled in through dedicated openings in form of guiding pipes through the turret. The pulling-in takes place by use of a wire pulled by a winch (not illustrated), the wire being brought over a movable guiding sheave. When the riser is pulled in to the correct position it is fastened by use of a fastening clamp or similar, which is secured by use of one or two bolts, for example.

The fastening between the adapter pipe and end coupling and bend restrictor can in principle be any known embodiment, for example flange coupling, clamp coupling and different collet- and sleeve couplings. This is also the case for the fastening or means for fastening of the end coupling for hanging up at deck level. The different elements in the termination are preferably formed such that they can be taken off for replacement or maintenance at demand.

The adapter pipe can preferably have a length such that the lower end of the adapter pipe extends down into the sea, preferably to a level below the wave impact zone. This will reduce the dynamical impact on the riser substantially, and thereby prolong the service life. For hanging up on platforms or installations without a turret, said embodiment is particularly preferable.

Between the bend restrictor and adaptor pipe an intermediate section can optionally be arranged. On FIG. 1 such an intermediate section 9 is illustrated, at level 10 at the bottom of the turret.

The guiding pipe 7 in the turret preferably has a funnel shaped lower end, to facilitate the pulling-in, and the guide pipe must have an inner diameter allowing that the terminated upper end of the flexible riser can be pulled through.

The invention claimed is:

1. A flexible riser structure, comprising:

a flexible riser with an upper end and a lower end, a bend restrictor with a lower end and an upper end, a guiding pipe, and a termination for hanging up on a vessel, a floating installation or a platform, wherein the upper end of the bend restrictor is connected to a lower end of an adapter pipe, the upper end of the flexible riser and an upper end of the adapter pipe are fastened to an end coupling of the termination, the lower end of the adaptor pipe is located higher than the upper end of the bend restrictor, the flexible riser extends through the bend restrictor and the adapter pipe, and a clamp surrounds an outer circumference of the end coupling of the termination for hanging up at a deck level on the vessel, the installation or the platform, wherein the guiding pipe surrounds the adapter pipe, the flexible riser is pullable through the guiding pipe, and the bend restrictor is slidable relative to the guiding pipe, and wherein the flexible riser is clamped by the clamp with bolts, the clamp is engaged with an external groove on the termination, a fastening is engaged with the upper end of the adapter pipe and an inner groove of the clamp, and the clamp is releasable from the flexible riser when the bolts are removed.

2. The flexible riser according to claim 1, wherein the bend restrictor with the adapter pipe is slidable relative to the flexible riser with the end coupling.

3. The flexible riser according to claim 1, wherein the end coupling comprises a lifting eye, for use during pull-in and hanging up.

4. The flexible riser according to claim 1, wherein the adapter pipe is rigid.

5. The flexible riser according to claim 4, wherein the adapter pipe in the upper end comprises an internal collar for hanging up in the end coupling.

6. A method for pulling-in and hanging up on the vessel or the floating installation of the flexible riser according to claim 1, comprising:

arranging a line from a winch on the vessel or installation to the upper end of the flexible riser, pulling-in the flexible riser by the winch through the guiding pipe in a turret arranged on the vessel or the installation, pulling-in the flexible riser to a position for fastening with the fastening at the deck level on the vessel or the installation, fastening the flexible riser by use of the fastening, thereby being hanged up.

7. The flexible riser according to claim 1, wherein the upper end of the adaptor pipe is spaced apart from the upper end of the bend restrictor.

8. The flexible riser according to claim 1, wherein the entire adaptor pipe is located higher than the entire bend restrictor.

* * * * *